US007081708B2

(12) United States Patent
Ito et al.

(10) Patent No.: US 7,081,708 B2
(45) Date of Patent: Jul. 25, 2006

(54) LIGHTING CIRCUIT

(75) Inventors: Masayasu Ito, Shizuoka-ken (JP); Hiroki Ishibashi, Shizuoka-ken (JP); Kentaro Murakami, Shizuoka-ken (JP); Hitoshi Takeda, Shizuoka-ken (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 170 days.

(21) Appl. No.: 10/684,738

(22) Filed: Oct. 14, 2003

(65) Prior Publication Data

US 2004/0075393 A1 Apr. 22, 2004

(30) Foreign Application Priority Data

Oct. 15, 2002 (JP) ..... 2002-300962

(51) Int. Cl.
*H05B 37/00* (2006.01)

(52) U.S. Cl. ..... 315/82; 315/224; 362/251; 362/543; 363/21.12; 363/23

(58) Field of Classification Search ..... 315/307, 315/224, 82; 362/251, 543; 363/21.12, 363/23

See application file for complete search history.

(56) References Cited

U.S. PATENT DOCUMENTS

| | | | | |
|---|---|---|---|---|
| 3,944,854 | A | 3/1976 | Keller | |
| 4,743,897 | A | 5/1988 | Perez | |
| 6,304,464 | B1 | 10/2001 | Jacobs et al. | |
| 6,641,294 | B1 * | 11/2003 | Lefebvre | 362/544 |
| 2001/0033503 | A1 | 10/2001 | Hamp et al. | |

FOREIGN PATENT DOCUMENTS

JP 2001-215913 8/2001

OTHER PUBLICATIONS

ESP@CENET Database—12, Patent No. JP2001215913, Publication Date: Aug. 10, 2001, 1 page.
French Search Report dated Sep. 22, 2004.

* cited by examiner

*Primary Examiner*—David Vu
(74) *Attorney, Agent, or Firm*—Osha Liang L.L.P.

(57) ABSTRACT

A lighting circuit for lighting a vehicular lamp including a plurality of light-emitting diodes, includes: a selection unit for selecting the number of light-emitting diodes to be connected in series in the vehicular lamp based on an instruction from the outside; a switching regulator for applying an output voltage based on a power-supply voltage output by an external DC power supply to the selected number of light-emitting diodes to be connected in series, so as to supply a supply current to the selected number of light-emitting diodes; and an output controlling unit for controlling the output voltage of the switching regulator based on the supply current.

4 Claims, 6 Drawing Sheets

LIGHTING CIRCUIT

This patent application claims priority from a Japanese patent application No. 2002-300962 filed on Oct. 15, 2002, the contents of which are incorporated herein by reference.

BACKGROUND OF THE INVENTION

1. Field of the Invention

The present invention relates to a lighting circuit. More particularly, the present invention relates to a lighting circuit for lighting a vehicular lamp.

2. Description of the Related Art

Conventionally, a switching regulator is known that supplies power to a light source of a vehicular lamp as disclosed in Japanese Patent Application Laid-Open No. 2001-215913, page 3 and FIG. 7, for example. An output voltage of the switching regulator is controlled based on, for example, a current flowing in the light source.

Various light sources such as a high-beam light source and a low-beam light source in a headlamp, are mounted on a vehicle. Therefore, in order to drive these various light sources by using the switching regulator, it is necessary to provide the switching regulator for each light source, thus increasing the cost.

SUMMARY OF THE INVENTION

Therefore, it is an object of the present invention to provide a lighting circuit, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a lighting circuit for lighting a vehicular lamp including a plurality of light-emitting diodes, comprises: a selection unit operable to select the number of light-emitting diodes to be connected in series in the vehicular lamp based on an instruction from an outside; a switching regulator operable to apply an output voltage based on a power-supply voltage output by an external DC power supply to the selected number of light-emitting diodes connected in series, to supply a supply current to the selected number of light-emitting diodes; and an output controlling unit operable to control the output voltage of the switching regulator based on the supply current.

The vehicular lamp may include two light source blocks connected in series each of which includes one or more light-emitting diodes, the selection unit may switch whether one of the two light source blocks is selected or both of the two light source blocks are selected, to select the number of the light-emitting diodes to be connected in series in the vehicular lamp, the lighting circuit may further comprise a switch that is connected in parallel to one of the two light source blocks while being connected in series with another one of the two light source blocks, the selection unit may make the switch conductive in a case where the one of the two light source blocks is not selected, and the switching regulator may output the supply current having approximately the same magnitude when the one of the two light source blocks is selected as that when the other one of the two light source blocks is selected.

The vehicular lamp may include two light source blocks connected in parallel, each of the two light source blocks may include light-emitting diodes connected in series, a number of the light-emitting diodes in one of the two light source blocks being different from that in another one of the two light source blocks, and the selection unit may select the number of light-emitting diodes to be connected in series in the vehicular lamp by switching which one of the two light source blocks is selected.

The number of the light-emitting diodes connected in series in the one of the two light source blocks may be smaller than the number of the light-emitting diodes connected in series in the other one of the two light source blocks, the lighting circuit may further comprise a switch that is connected in series with the one of the two light source blocks while being connected in parallel to the other one of the two light source blocks, and the selection unit may make the switch conductive in a case of selecting the one of the two light source blocks.

According to the second aspect of the present invention, a lighting circuit for lighting a vehicular lamp including a light-emitting diode, comprises: a switching regulator including a transformer and a switching device, wherein the transformer includes a primary coil operable to receive a power-supply current output by an external DC power supply and a secondary coil operable to supply a supply current to the light-emitting diode by applying an output voltage higher than a power-supply voltage to the light-emitting diode based on the power-supply current, and wherein the switching device is connected to the primary coil of the transformer in series and switches whether or not the power-supply current is supplied to the primary coil; and an output controlling unit operable to control a duration ratio of a period in which the switching device is on or off based on the supply current, to control the output voltage of the secondary coil.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
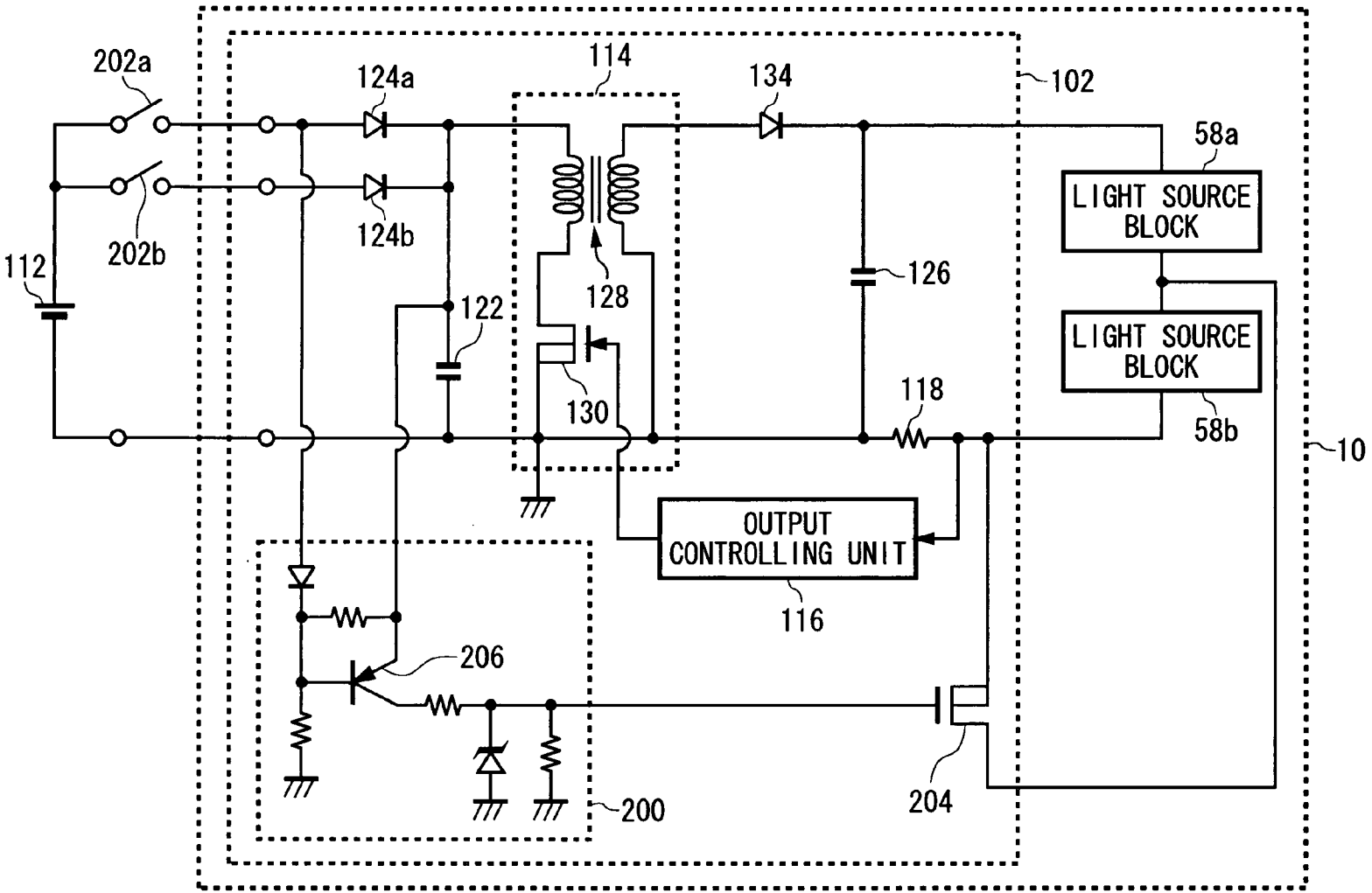
FIG. 1 shows an exemplary circuit structure of a vehicular lamp 10 according to an embodiment of the present invention.

FIG. 1 shows an exemplary structure of a vehicular lamp 10 according to an embodiment of the present invention. The vehicular lamp 10 of this example selects the number of light-emitting diodes to be connected in series in the vehicular lamp 10 so as to selectively light the light-emitting diodes. The vehicular lamp 10 includes two light source blocks 58*a*, 58*b* and a lighting circuit 102. The vehicular lamp 10 may include more, for example, three or more light source blocks 58. The light source blocks 58*a* and 58*b* are connected in series and each includes one or more light-emitting diodes connected in series. In this example, the light source block 58*a* is a low-beam light source of a headlamp, while the light source block 58*b* is a high-beam light source of the headlamp.

The lighting circuit 102 includes a switch 204, a plurality of diodes 124*a* and 124*b*, a light-source selection unit 200, a switching regulator 114, a resistor 118, an output controlling unit 116, a capacitor 122 and a plurality of capacitors 126 and 134. The switch 204 is an NMOS transistor and is connected in parallel to the light source 58*b* while being connected in series with the light source block 58*a*.

The lighting circuit 102 receives power from a DC power supply 112 provided in the outside of the vehicular lamp 10 via a high-beam switch 202*a* or a low-beam switch 202*b* that is provided in the outside of the vehicular lamp 10, and supplies the thus received power to the light source block 58*a* and/or the light source block 58*b*. Each of the high-beam switch 202*a* and the low-beam switch 202*b* is a switch for switching whether or not a power-supply voltage output by the DC power supply 112 is supplied to the switching regulator 114 based on an instruction from the outside. Each of the high-beam switch 202*a* and the low-beam switch 202*b* is electrically connected to the switching regulator 114 via the corresponding one of diodes 124*a* and 124*b* for providing protection against reverse connection. The high-beam switch 202*a* and the low-beam switch 202*b* are provided on the driver's side in a vehicle, for example.

The light-source selection unit 200 includes a PNP transistor 206, a diode, a plurality of resistors and a Zener diode. In a case where the high-beam switch 202*a* is off, the PNP transistor 206 is turned on so as to turn the switch 204 on. In this case, the light-source selection unit 200 makes the switch 204 electrically short-circuit an anode and a cathode of the light source block 58*b*, thereby selecting one of two light source blocks 58*a* and 58*b*, i.e., the light source block 58*a*.

On the other hand, in a case where the high-beam switch 202*a* is on, the PNP transistor 206 is turned off so as to turn the switch 204 off. In this case, the light-source selection unit 200 prevents the switch 204 from electrically short-circuiting the anode and the cathode of the light source block 58*b*, thereby selecting both the two light source blocks 58*a* and 58*b*. In other words, in a case where the light-source selection unit 200 does not select the light source block 58*b*, the light-source selection unit 200 makes the switch 204 conductive.

In this manner, the light-source selection unit 200 switches whether one of the two light source blocks 58*a* and 58*b* is selected or both of them are selected. Moreover, in this manner, the light-source selection unit 200 selects the number of the light-emitting diodes to be connected in series in the vehicular lamp 10 based on the instruction from the outside.

In this example, the base terminal of the PNP transistor 206 is connected to a pull-down resistor and is also connected electrically to the emitter terminal thereof via a resistor. Moreover, the collector terminal of the PNP transistor 206 is connected to a pull-down resistor and the voltage thereof is clamped by the Zener diode.

The switching regulator 114 includes an NMOS transistor 130 and a transformer 128. The NMOS transistor 130 is a switch that switches whether or not a power-supply current based on the power-supply voltage is supplied to a primary coil of the transformer 128 by being connected in series with the primary coil of the transformer 128. The transformer 128 outputs an output voltage based on the power-supply current received at its primary coil, from its secondary coil.

In this example, the secondary coil supplies a high-voltage output to an anode of the light source block 58*a* via the diode 134 and supplies a low-voltage output to a cathode of the light source block 58*b* via the resistor 118, thereby outputting a supply current. Thus, the switching regulator 114 applies the output voltage to the light-emitting diodes connected in series the number of which was selected by the light-source selection unit 200, and supplies the supply current to these light-emitting diodes.

More specifically, in a case where the high-beam switch 202*a* is off, the switching regulator 114 supplies the supply current to the light source block 58*a*. On the other hand, in a case where the high-beam switch 202*a* is on, the switching regulator 114 supplies the supply current to both the light source blocks 58*a* and 58*b*. Please note that the switching regulator 114 may output the supply current having approximately the same magnitude when one of the light source blocks 58*a* and 58*b* is selected as the magnitude of the supply current when the other light source block is selected. In this case, it is possible to simply control the switching regulator 114.

In this example, the switching regulator 114 is a flyback type switching regulator. In an alternative example, the switching regulator 114 may be other type, such as a forward type or a step-down type. Moreover, the switching regulator 114 may include a coil for supplying the current received from the DC power supply 112, to the light source block 58, in place of the transformer 128.

The resistor 118 generates a current-detection voltage, that is a voltage based on the supply current, across the resistor 118 by being connected in series with each of the two light source blocks 58*a* and 58*b*. The output controlling unit 116 controls a duration ratio of a period in which the NMOS transistor 130 is on or off based on the current-detection voltage, so as to control the output voltage and the output current of the switching regulator 114. According to this example, it is possible to selectively light two light source blocks 58*a* and 58*b* by a single switching regulator 114. Also, this can reduce the cost of the vehicular lamp 10.

In another example, the switch 204 may be connected to the light source block 58*a* in parallel while being connected to the light source block 58*b* in series. In this case, the light-source selection unit 200 selects one of the two light source blocks 58*a* and 58*b*, i.e., the light source block 58*b* or both the two light source blocks 58*a* and 58*b*. It is preferable that the light-source selection unit 200 select both the two light source blocks 58*a* and 58*b* in a case where the high-beam switch 202 is on.

In another example, an ECU (Electronics Control Unit) mounted on a vehicle may include the light-source selection unit 200 or the structure having the same or similar function as/to that of the light-source selection unit 200. Moreover, the lighting circuit 102 may include an integrated circuit having the same or similar function as/to that of the light-source selection unit 200.

Figure 2A:
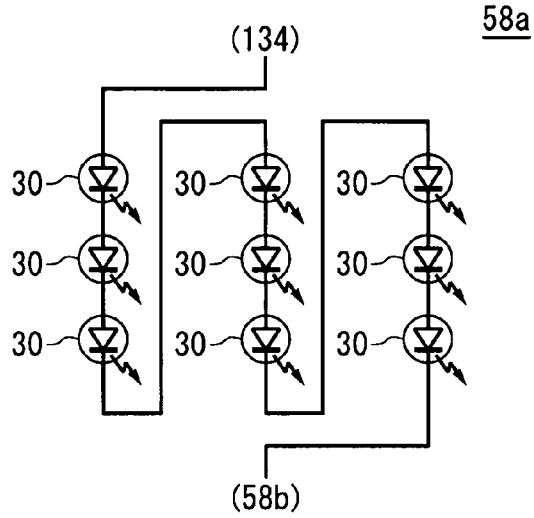
FIG. 2A shows an exemplary structure of a light source block 58*a*.

FIG. 2A shows an exemplary structure of the light source block 58*a*. In this example, the light source block 58*a* includes a plurality of light-emitting diodes 30 connected in series. Each light-emitting diode 30 emits light in accordance with the supply current received by the light source block 58*a*. In an alternative example, the light source block 58*a* may include one light-emitting diode 30. Moreover, the light source block 58*b* may have the same or similar function as/to that of the light source block 58*a*.

Figure 2B:
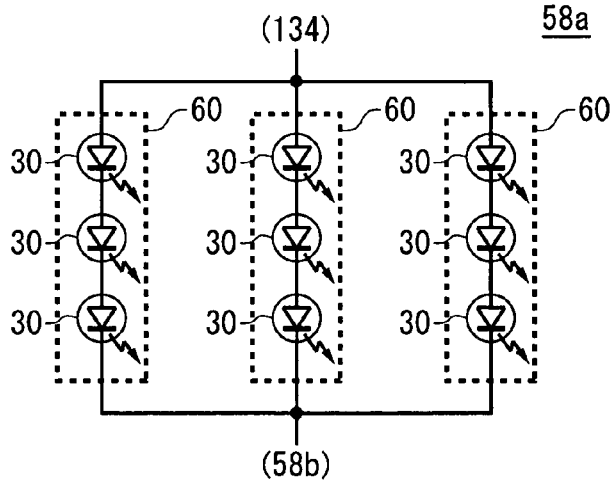
FIG. 2B shows another exemplary structure of the light source block 58*a*.

FIG. 2B shows another exemplary structure of the light source block 58*a*. In this example, the light source block 58*a* includes a plurality of light source units 60 connected in parallel. Each light source unit 60 includes one or more light-emitting diodes 30 connected in series.

The light source block 58*b* may have the same or similar function as/to that of the light source block 58*a*, and may include light source unit(s) 60 the number of which is different from the number of the light source units 60 included in the light source block 58*a*. The light source unit 60 in the light source block 58*b* may include the light-emitting diode(s) 30 the number of which is different from the number of the light-emitting diode(s) 30 in the light source unit 60 in the light source block 58*a*.

Figure 2C:
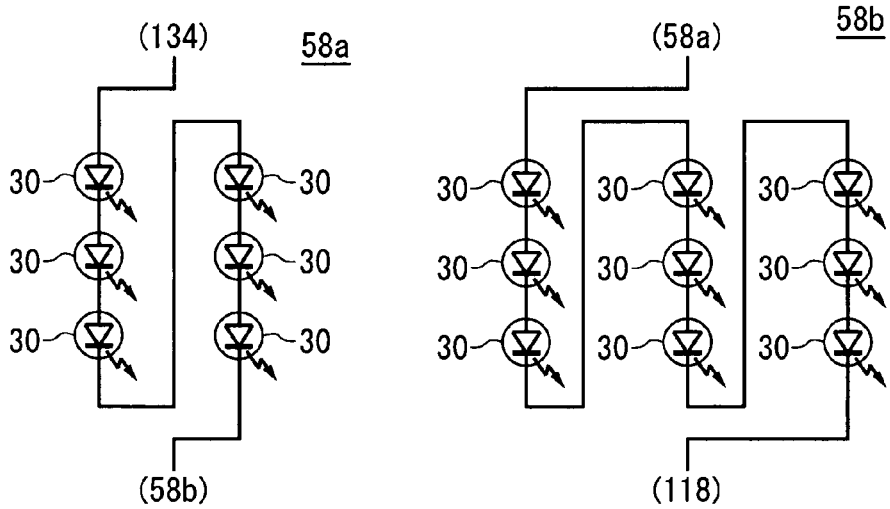
FIG. 2C shows still another exemplary structure of the light source blocks 58*a* and 58*b*.

FIG. 2C shows still another exemplary structure of the light source blocks 58*a* and 58*b*. In this example, each of the light source blocks 58*a* and 58*b* includes one or more light-emitting diodes 30 connected in series, the number of the light-emitting diode(s) 30 being different between the light source blocks 58*a* and 58*b*. In this example, the number of the light-emitting diode(s) 30 connected in series in the light source block 58*a* is smaller than that in the light source block 58*b*. Thus, a forward-direction bias voltage generated in the light source block 58*a* in accordance with the lighting of the light-emitting diode(s) 30 is lower than that generated in the light source block 58*b*.

Figure 3:
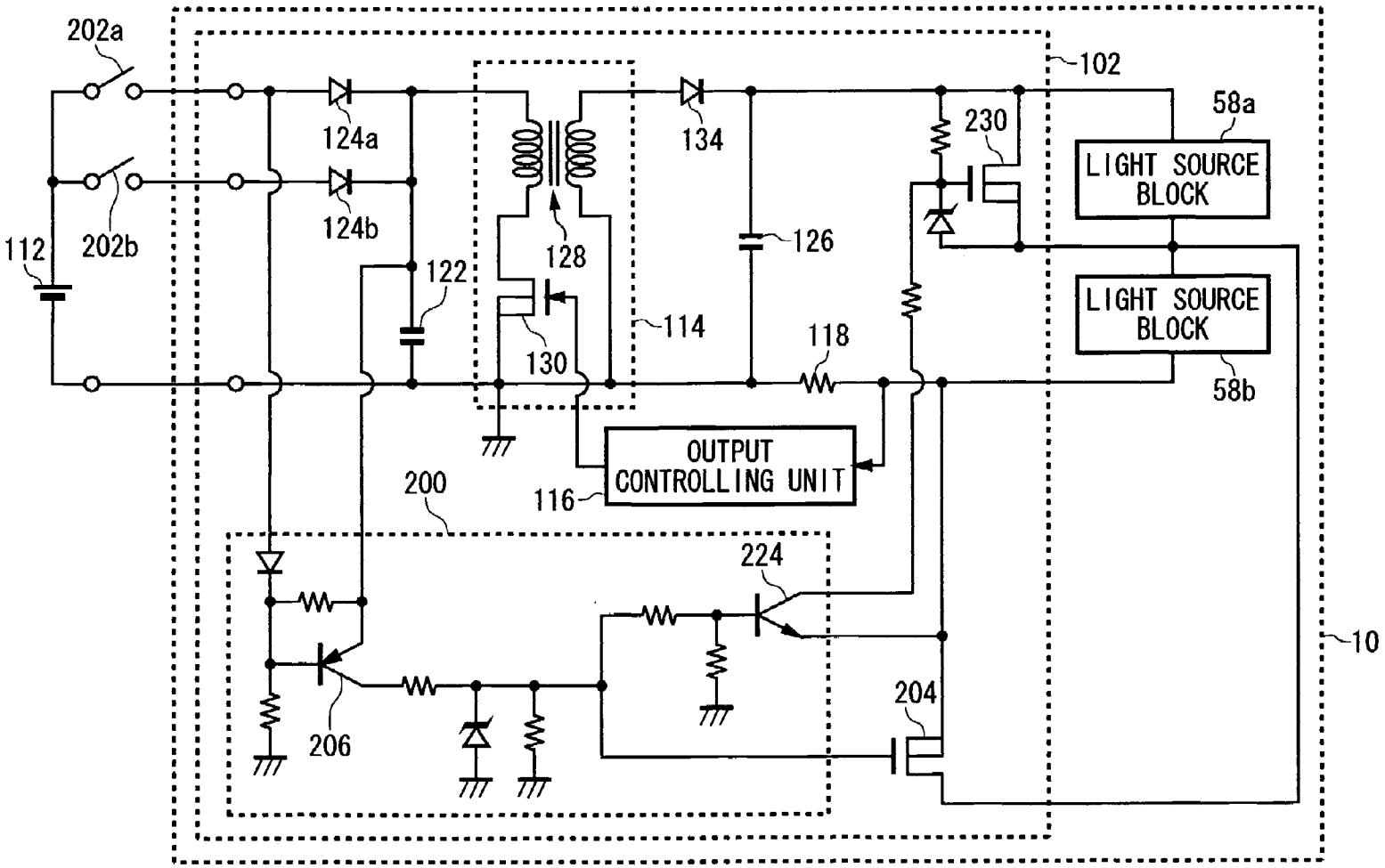
FIG. 3 shows another exemplary circuit structure of the vehicular lamp 10.

FIG. 3 shows another exemplary circuit structure of the vehicular lamp 10. In this example, the lighting circuit 102 further includes a switch 230, a plurality of resistors and a Zener diode. The switch 230 is an NMOS transistor that is connected in parallel to the light source block 58*a* while being connected in series with the light source block 58*b*. Thus, the switch 230 electrically short-circuits the anode and cathode of the light source block 58*b* when being turned on. A gate terminal of the switch 230 is connected to a pull-up resistor and is electrically connected to the cathode of the light source block 58*a* via the Zener diode.

The light-source selection unit 200 further includes an NPN transistor 224 and a plurality of resistors. The PNP transistor 206 turns the switch 230 off in a case where the switch 204 is turned on, and turns the switch 230 on in a case where the switch 204 is turned off.

In this manner, the light-selection unit 200 selects one of the light source blocks 58*a* and 58*b* or the other light source block based on the instruction from the outside. Also in this example, it is possible to selectively light two light source blocks 58*a* and 58*b* by a single switching regulator 114. Except for the above, the structure in FIG. 3 labeled with the same reference numerals as those in FIG. 1 has the same or similar function as/to that of the structure in FIG. 1 and therefore the description thereof is omitted.

Figure 4:
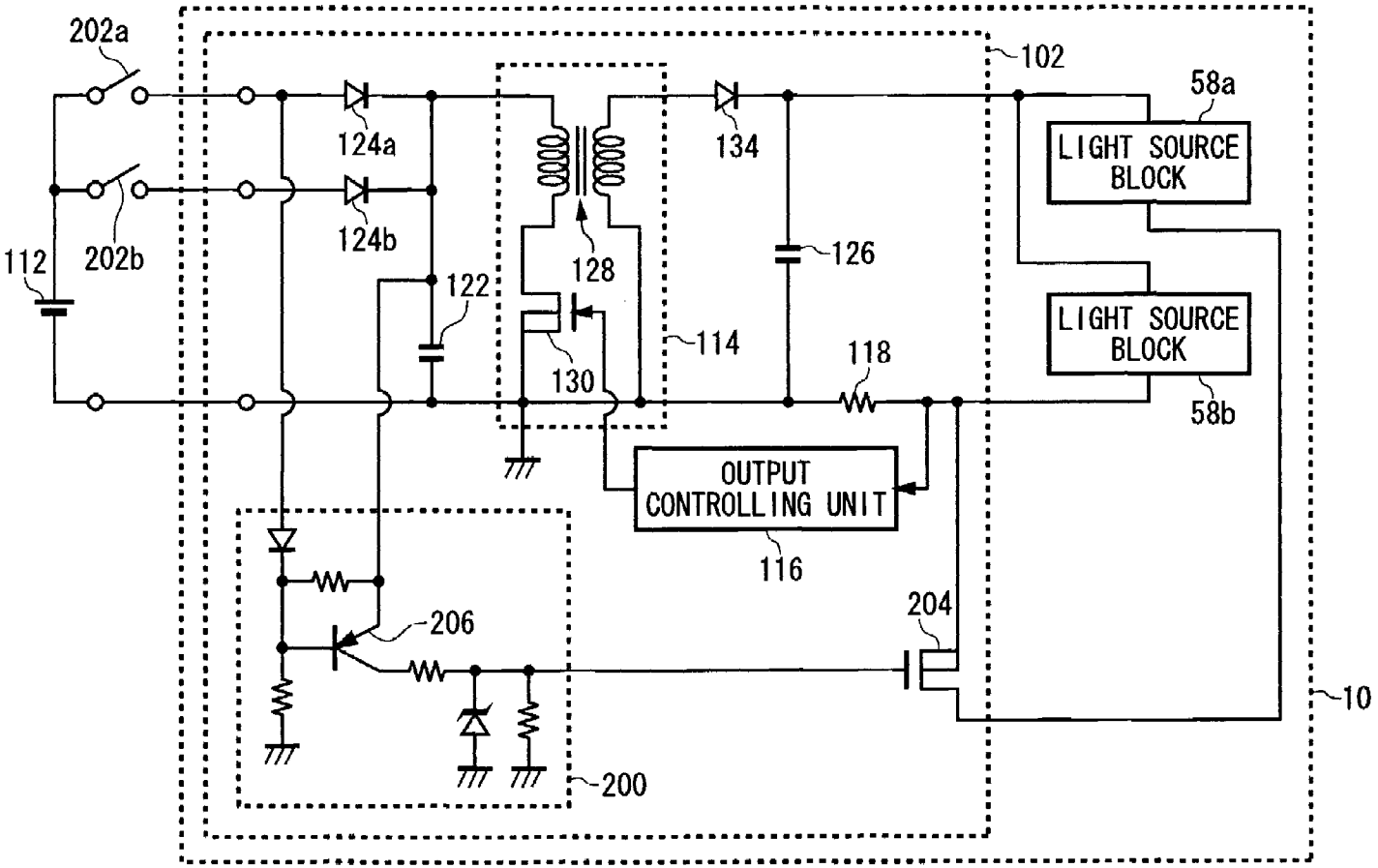
FIG. 4 shows still another exemplary circuit structure of the vehicular lamp 10.

FIG. 4 shows still another example of the circuit structure of the vehicular lamp 10. In this example, the light source blocks 58*a* and 58*b* are connected in parallel. The light source blocks 58*a* and 58*b* have the same or similar structures as those of the light source blocks 58*a* and 58*b* described referring to FIG. 2C.

Thus, when the switch 204 has been turned on, the switching regulator 114 outputs the output voltage corresponding to the forward-direction bias voltage generated in the light source block 58*a*. In this case, no supply current flows in the light source block 58*b* and the switching regulator 114 supplies the supply current to the light source block 58*a*. On the other hand, when the switch 204 has been turned off, no supply current flows in the light source block 58*a*. Thus, the switching regulator 114 supplies the supply current to the light source block 58*b*. In this case, the switching regulator 114 outputs the output voltage corresponding to the forward-direction bias voltage generated in the light source block 58*b*. That is, in this example, the light-selection unit 200 makes the switch 204 conductive in a case of selecting the light source block 58*a*.

Also in this example, it is possible to selectively light two light source blocks 58*a* and 58*b* by a single switching regulator 114. Except for the above, the structure in FIG. 4 having the same reference numerals as those in FIG. 1 has the same or similar function as/to that of the structure in FIG. 1 and therefore the description thereof is omitted.

In an alternative example, the output controlling unit 116 may control a duration ratio of a period in which the NMOS transistor 130 is on or off based on the output voltage of the switching regulator 114. It is preferable that the output controlling unit 116 change the output of the switching regulator in accordance with the state of the high-beam switch 202*a*.

For example, in a case where the high-beam switch 202*a* is off, the output controlling unit 116 makes the switching regulator 114 output the output voltage corresponding to the forward-direction bias voltage generated in the light source block 58*a*. In this case, the switching regulator 114 supplies the supply current to the light source block 58*a*.

In a case where the high-beam switch 202*a* is on, the output controlling unit 116 makes the switching regulator 114 outputs the output voltage corresponding to the forward-direction bias voltage generated in the light source block 58*b*. In this case, the switching regulator 114 supplies the supply current to both the light source blocks 58*a* and 58*b*.

Thus, the switching regulator 114 outputs the supply current having the magnitude corresponding to the number of the selected light source blocks. Also in this example, it is possible to selectively light two light source blocks 58*a* and 58*b* by a single switching regulator 114. Please note that it is preferable that the light source block 58*a*, that includes the light-emitting diode(s) 30 connected in series (see FIG. 2C) less than those in the light source block 58*b*, further include a resistor connected in series with the light-emitting diode(s) 30.

Figure 5:
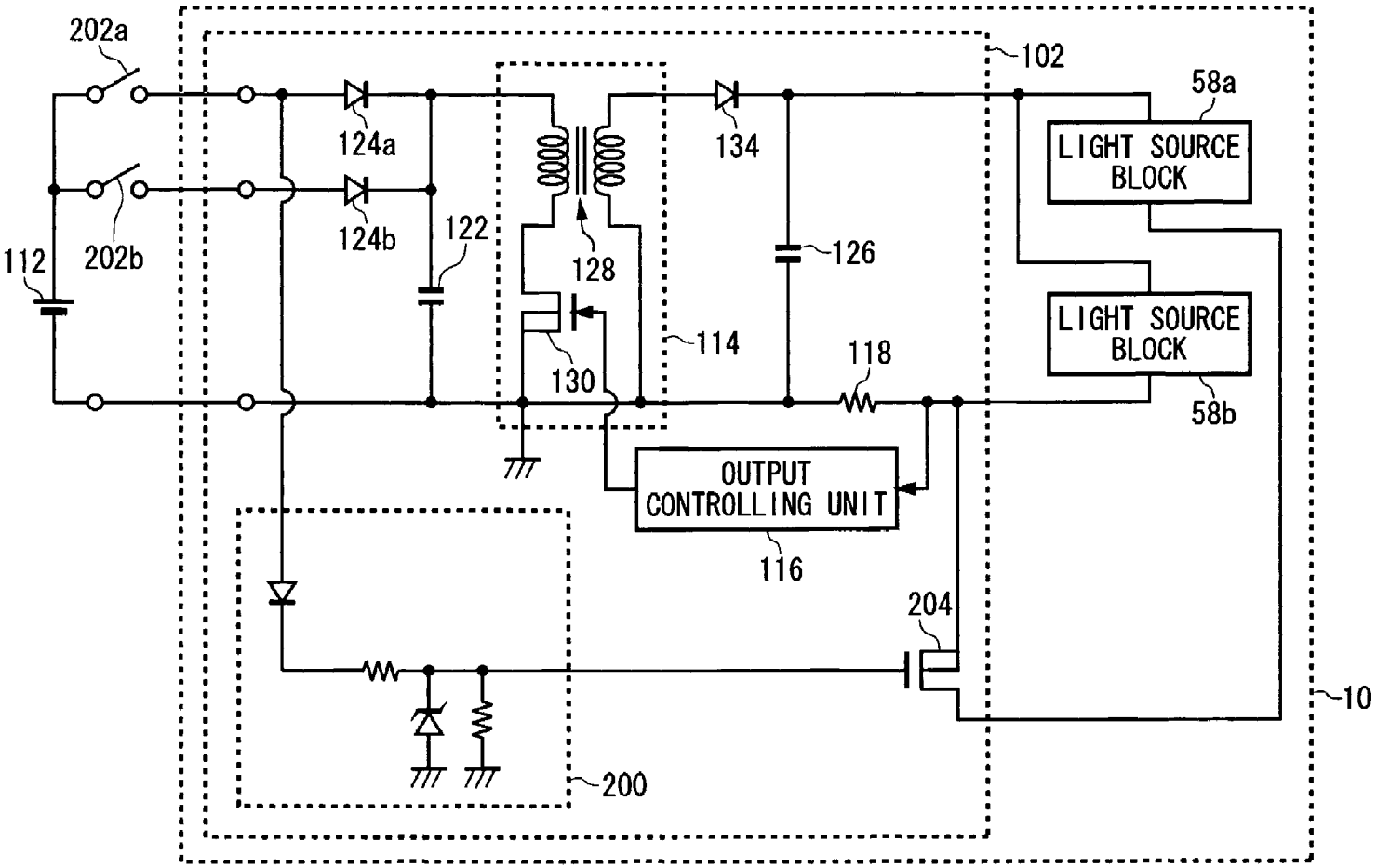
FIG. 5 shows still another exemplary circuit structure of the vehicular lamp 10.

FIG. 5 shows still another example of the circuit structure of the vehicular lamp 10. In FIG. 5, the structure having the same reference numerals as those in FIG. 4 has the same or similar function as/to that of the structure in FIG. 4 and therefore the description thereof is omitted. In this example, the light source block 58*b* emits a low beam while the light source block 58*a* emits a high beam. In this example, the light-source selection unit 200 supplies a voltage at an output end of the high-beam switch 202*a* to the gate terminal of the switch 204.

Thus, in a case where the high-beam switch 202*a* is off, the switching regulator 114 supplies the supply current to the light source block 58*b*. In a case where the high-beam switch 202*a* is on, the switching regulator 114 supplies the supply current to the light source block 58*a*. Also in this example, it is possible to selectively light two light source blocks 58*a* and 58*b* by a single switching regulator 114. Moreover, according to this example, the number of the parts of the vehicular lamp 10 can be reduced.

Figure 6:
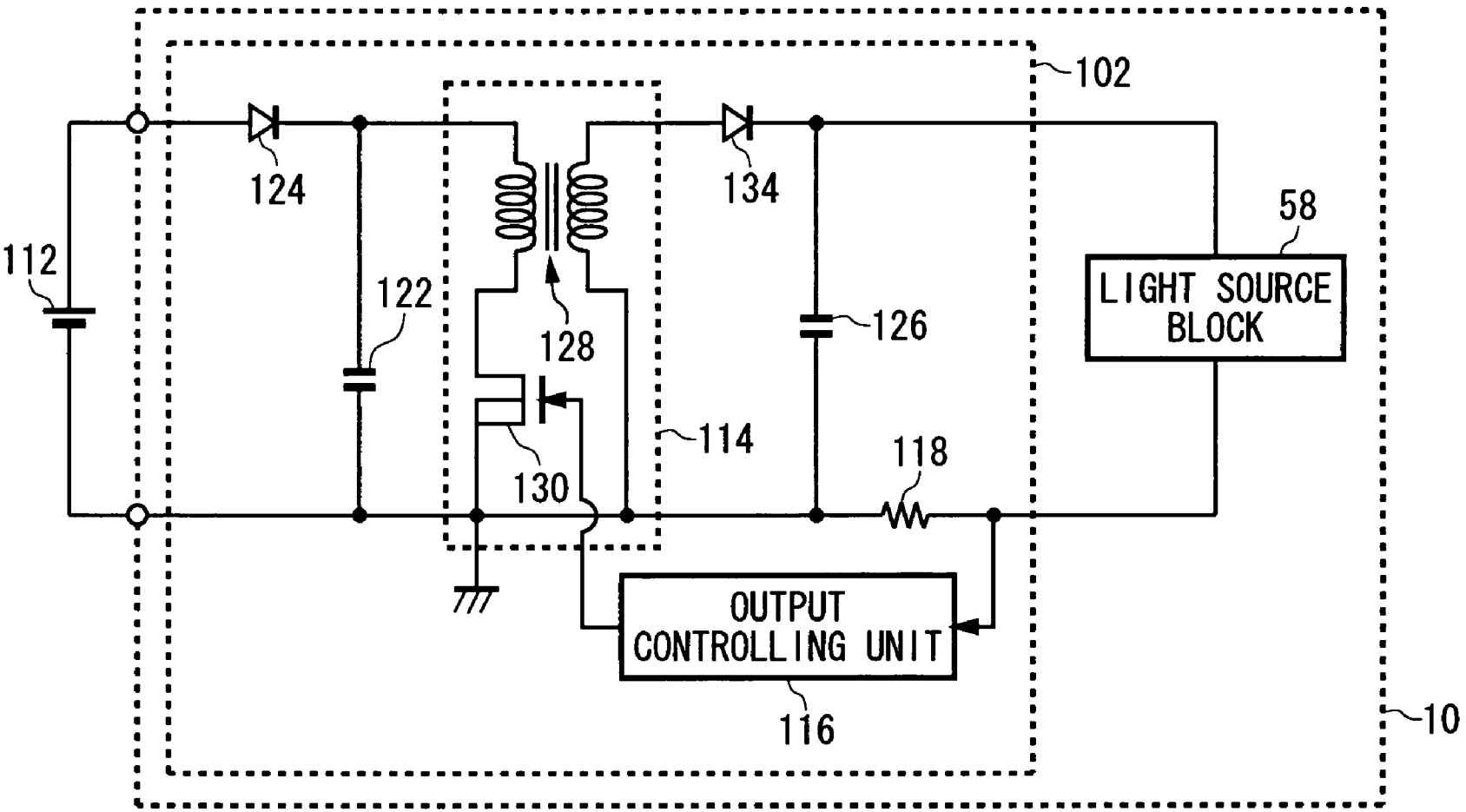
FIG. 6 shows still another exemplary circuit structure of the vehicular lamp 10.

FIG. 6 shows still another example of the circuit structure of the vehicular lamp 10. The vehicular lamp 10 of this example enables the light-emitting diode 30 to emit light with high efficiency. In this example, the vehicular lamp 10 includes one light source block 58, in place of the light source blocks 58*a* and 58*b*.

The light source block 58 has the same or similar structure as/to the structure of the light source block 58*a* described referring to FIG. 2A. The light source block 58 may have the same or similar structure as/to that of the light source block 58*a* described referring to FIG. 2B. The light source block 58 of this example is a light source of a rear high mount brake lamp and a rear combination lamp such as a taillight, a stop lamp, rear turn signal and/or rear fog lamp of a vehicle.

The switching regulator 114 increases the power-supply voltage to the output voltage that is higher than the sum of forward-direction bias voltages of a plurality of light-emitting diodes 30 (see FIG. 2A) in the light source block 58. The switching regulator 114 then applies that output voltage to these light-emitting diodes 30 connected in series, thereby supplying the supply current to these light-emitting diodes 30. In this case, the secondary coil of the transformer 128 outputs the output voltage higher than the power-supply voltage, based on the power-supply current.

In this example, the switching regulator 114 outputs the output voltage higher than the power-supply voltage. Thus, it is possible to increase the number of the light-emitting diodes 30 connected in series in the light source block 58. In this case, the supply current for causing a predetermined number of light-emitting diodes 30 to emit light having a predetermined light amount can be reduced. Moreover, the vehicular lamp 10 can make the light-emitting diode 30 emit light with high efficiency.

It is preferable that the switching regulator 114 increase the power-supply voltage to a voltage lower than or equal to approximately 60 V. In this case, a risk of an electric shock to a user can be reduced, for example, thereby the safe and efficient vehicular lamp 10 can be provided. Except for the above, the structure in FIG. 6 having the same reference numerals as those in FIG. 1 has the same or similar function as/to that of the structure shown in FIG. 1 and therefore the description thereof is omitted.

As is apparent from the above, according to the present invention, the cost of the vehicular lamp can be reduced.

Although the present invention has been described by way of exemplary embodiments, it should be understood that those skilled in the art might make many changes and substitutions without departing from the spirit and the scope of the present invention which is defined only by the appended claims.

What is claimed is:

1. A lighting circuit for lighting a vehicular lamp comprising a plurality of light source blocks respectively comprising a plurality of light-emitting diodes connected in series, comprising:

a selection unit operable to select at least one of the plurality of light source blocks, thereby selecting a number of light-emitting diodes to be connected in said vehicular lamp based on an external instruction;

a switch operable not to flow a current through at least one of the light source blocks not selected according to the selection of said selection unit;

a switching regulator operable to apply an output voltage based on a power-supply voltage output by an external DC power supply to said selected number of light-emitting diodes, to supply a supply current to said selected number of light-emitting diodes; and an output controlling unit operable to control said output voltage of said switching regulator based on said supply current, wherein said vehicular lamp comprises two light source blocks connected in series, said switch is connected in parallel to a first of said two light source blocks while being connected in series with a second of said two light source blocks, said selection unit makes said switch conductive in a case where said first of said two light source blocks is not selected, and said switching regulator outputs said supply current having approximately the same magnitude irrespective of whether said first of said two light source blocks is selected.

2. A lighting circuit for lighting a vehicular lamp comprising a plurality of light source blocks respectively comprising a plurality of light-emitting diodes connected in series, comprising:

a selection unit operable to select at least one of the plurality of light source blocks, thereby selecting a number of light-emitting diodes to be connected in said vehicular lamp based on an external instruction;

a switch operable not to flow a current through at least one of the light source blocks not selected according to the selection of said selection unit;

a switching regulator operable to apply an output voltage based on a power-supply voltage output by an external DC power supply to said selected number of light-emitting diodes, to supply a supply current to said selected number of light-emitting diodes; and an output controlling unit operable to control said output voltage of said switching regulator based on said supply current, wherein a number of said light-emitting diodes connected in series in said first of said two light source blocks is smaller than a number of said light-emitting diodes connected in series in said second of said two light source blocks, said switch is connected in series with said first of said two light source blocks while being connected in parallel to said second of said two light source blocks, and said selection unit makes said switch conductive in a case of selecting said first of said two light source blocks.

3. A lighting circuit for lighting a vehicular lamp, comprising:

two light source blocks connected in series, each light source block comprising one or more light emitting diodes connected in series;

a switch that is connected in parallel to a first of said two light source blocks while being connected in series with a second of said two light source blocks;

a selection unit operable to select at least one of said two light source blocks, thereby selecting a number of light-emitting diodes to be connected in series in said vehicular lamp based on an external instruction, wherein said selection unit makes said switch conductive in a case where said first of said two light source blocks is not selected;

a switching regulator operable to apply an output voltage based on a power-supply voltage output by an external DC power supply to said selected number of light emitting diodes connected in series, to supply a supply current to said selected number of light emitting diodes connected in series, wherein said switching regulator outputs said supply current having approximately the same magnitude when said first of said two light source blocks is selected as when said second of said two light source blocks is selected; and an output controlling unit operable to control said output voltage of said switching regulator based on said supply current.

4. A lighting circuit for lighting a vehicular lamp, comprising:

two light source blocks connected in series, each light source block comprising one or more light emitting diodes connected in series, wherein a number of light-emitting diodes connected in series in a first of said two light source blocks is smaller than a number of light-emitting diodes connected in series in a second of said two light source blocks;

a switch that is connected in series with the first of said two light source blocks and connected in parallel to the second of said two light source blocks;

a selection unit operable to select at least one of said two light source blocks, thereby selecting a number of light-emitting diodes to be connected in series in said vehicular lamp based on an external instruction, wherein said selection unit makes said switch conductive when selecting said first of said two light source blocks;

a switching regulator operable to apply an output voltage based on a power-supply voltage output by an external DC power supply to said selected number of light-emitting diodes connected in series, to supply a supply current to said selected number of light-emitting diodes; and an output controlling unit operable to control said output voltage of said switching regulator based on said supply current.

* * * * *